US007744089B2

(12) United States Patent
Huang

(10) Patent No.: US 7,744,089 B2
(45) Date of Patent: Jun. 29, 2010

(54) BALL PRACTICE DEVICE

(76) Inventor: Husheng Huang, Unit 2, 3/F, 3rd Building, Shuianxindu, Longgang Street, Longgang District, Shenzhen (CN) 518114

( * ) Notice: Subject to any disclaimer, the term of this patent is extended or adjusted under 35 U.S.C. 154(b) by 0 days.

(21) Appl. No.: 12/330,097

(22) Filed: Dec. 8, 2008

(65) Prior Publication Data

US 2010/0093471 A1 Apr. 15, 2010

(30) Foreign Application Priority Data

Oct. 9, 2008 (CN) ..... 2008 2 0212905 U

(51) Int. Cl.
*A63B 63/00* (2006.01)
*A63B 69/36* (2006.01)

(52) U.S. Cl. ..... 273/400; 473/478; 473/197; 473/421

(58) Field of Classification Search ..... 273/398–402; 473/454, 476, 478
See application file for complete search history.

(56) References Cited

U.S. PATENT DOCUMENTS 4,489,941 A * 12/1984 Shieh ..... 473/197
4,905,996 A * 3/1990 Tallent et al. ..... 473/197
5,351,948 A * 10/1994 Thomas ..... 473/417
5,549,304 A * 8/1996 Davis ..... 273/396
5,772,537 A * 6/1998 Anderson et al. ..... 473/435
6,264,573 B1 * 7/2001 Zheng ..... 473/471
6,607,455 B1 * 8/2003 Petras ..... 473/478
6,991,567 B2 * 1/2006 Wong et al. ..... 473/478
7,021,630 B1 * 4/2006 Cho ..... 273/401
7,198,274 B2 * 4/2007 Cho ..... 273/400
7,264,245 B2 * 9/2007 Cho ..... 273/396
2001/0034271 A1 * 10/2001 Nozato ..... 473/197
2006/0226607 A1 * 10/2006 Chen ..... 273/407

* cited by examiner

*Primary Examiner*—Mark S Graham
(74) *Attorney, Agent, or Firm*—Hamre, Schumann, Mueller & Larson, P.C.

(57) ABSTRACT

The present invention relates to a ball practice device, which comprises a frame, a net, a base bracket and a supporting assembly. The supporting assembly is interposed between the frame and the base bracket, and is configured for supporting the frame together with the base bracket. The net is attached to the frame and is connected to the frame by a connecting member which the net can be disassembled from.

7 Claims, 5 Drawing Sheets

BALL PRACTICE DEVICE

FIELD OF THE INVENTION

The present invention relates to exercise equipments and, more particularly to a ball practice device.

BACKGROUND

At present, sports have become an important part of people's daily life. Specifically, a variety of sports and games afford pleasure in people's life. In general, when people want to take some sports, for example, football, hockey ball, baseball, tennis ball and golf, etc., they have to go to special grounds to practise or have these sports. How ever, it is time-consuming and inconvenient for people to do sports in special grounds because the grounds always are crowded, as a result, people cannot concentrate on in their practice or sports due to external disturbance. More unfavorably, the players have to be weighed down with picking up balls. It is rather time-consuming and arduous for the players to picking up the tennis balls or golf balls. Consequently, the practicers have been fatigue due to frequently picking-up behave before they achieve sufficient exercise.

Therefore, a number of suspension curtain nets are applied in many superior stadiums and gymnasiums to buffer and capture the flying balls. However, the nets are too big and heavy and thus require corresponding broad space. Further, once the nets are suspended and fixed, it is inconvenient to move the nets to other place. A traditional ball practice device typically includes a frame and a back for supporting the frame. A net is attached to the frame, for capturing balls which is struck by the practicer. The frame is typically made of, e.g., flexible material, and is defined to be desired shape by being wrapped with a fabric tape. The net is sewed in the fabric tape and thus is configured as a whole together with the frame. As such, when one of the net and the frame is breakage, the entire ball practice device needs to be cast off and be replaced with a new one. Actually, the net is prone to be broken up due to long-term strike by the balls, accordingly decreasing the service period.

There is a need for, therefore, a ball practice device which is provided with a substitutable net and has a perfect availability.

SUMMERY

In accordance with an embodiment of the present invention, a ball practice device comprises a frame, a net, a base bracket and a supporting assembly. The supporting assembly is interposed between the frame and the base bracket, and is configured (i.e., arranged or adapted) for supporting the frame together with the base bracket. The net is attached to the frame and is connected to the frame by a connecting member which the net can be disassembled from.

Since the net is attached to the frame by the connecting member which the net can be disassembled from, it is convenient to disassemble the net from the frame and fix the net to the frame. Thus, the connecting member provides convenience for replacing the net which is broken up after long-term exercise. This decreases expense of the practicer's sport, increases availability and use value of the device, and also prolongs service period of the device.

Other objects, advantages and novel features of the present invention will become more apparent from the following detailed description when taken in conjunction with the accompanying drawings, in which:

DETAILED DESCRIPTION OF THE PREFERRED EMBODIMENTS

Objects, advantages and embodiments of the present invention will be explained below in detail with reference to the accompanying drawings. However, it is to be appreciated that the following description of the embodiment(s) is merely exemplary in nature and is no way intended to limit the invention, its application, or uses.

Figure 1:
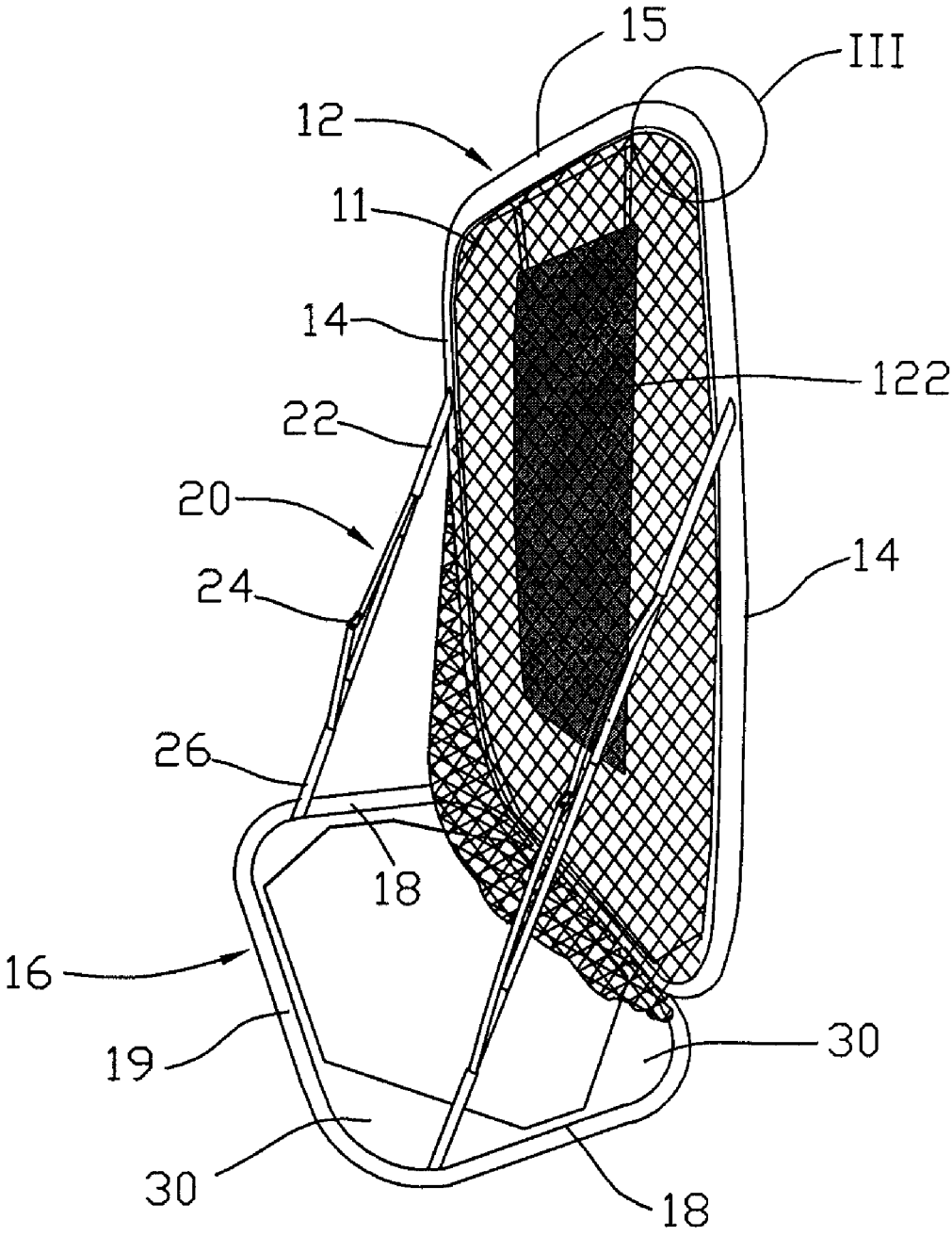
FIG. 1 is a schematic, isometric view of a ball practice device according to a first embodiment of the present invention.
Figure 2:
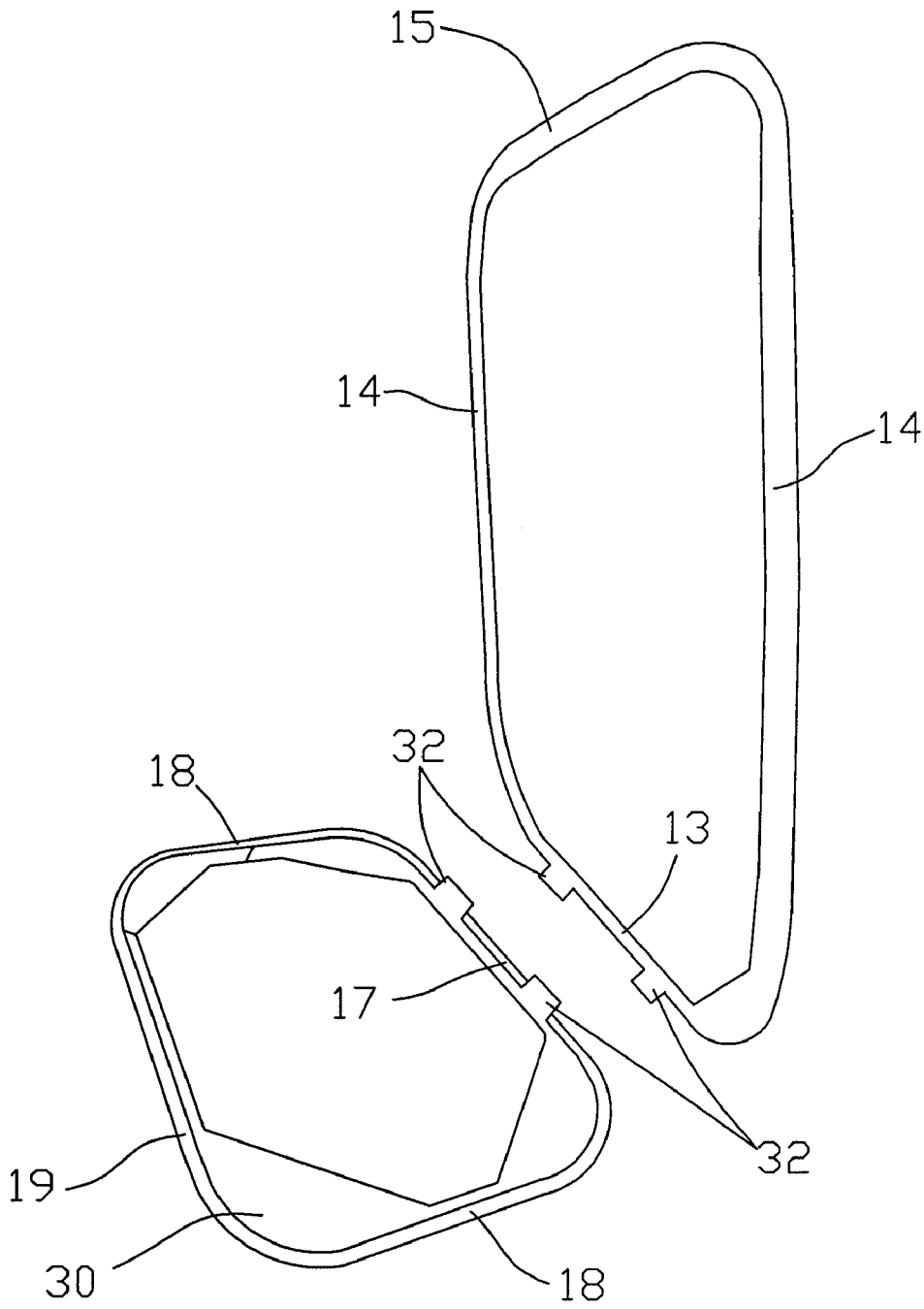
FIG. 2 is a schematic, structural view of the disassembled frame and base bracket of the device of FIG. 1.

FIGS. 1 and 2 illustrate a ball practice device 10, in accordance with a first embodiment of the present invention. In this embodiment, the device 10 includes a frame 12, a net 11, a base bracket 16 and a supporting assembly 20. The supporting assembly 20 is interposed between the frame 12 and the base bracket 11, and is configured for supporting the frame 12 together with the base bracket 16. The net 11 is attached to the frame 12 and is connected to the frame 12 by a connecting member which the net 11 can be disassembled from.

The frame 12 includes a lower segment 13, two side segments 14 respectively adjoining two ends of the lower segment 13, and an upper segment 16 opposite to the lower segment 13. In the illustrated embodiment, the lower segment 13, two side segments 14 and the upper segment 16 are configured or integrated as a whole (i.e., the frame 12), and are made of, e.g., flexible or pliable steel material. The base bracket 16 includes a connecting portion 17, two side portions 18 adjoining two ends of the connecting portion 17, and a portion 19 opposite to the connecting portion 17. The four portions of the base bracket 16 are configured or integrated as a whole (i.e., the base bracket 16), and are made of, e.g., flexible or pliable steel material. The frame 12 and the base bracket 16 are connected to each other by a connecting mechanism which can be disassembled to depart the frame 12 from the base bracket 16.

Figure 3:
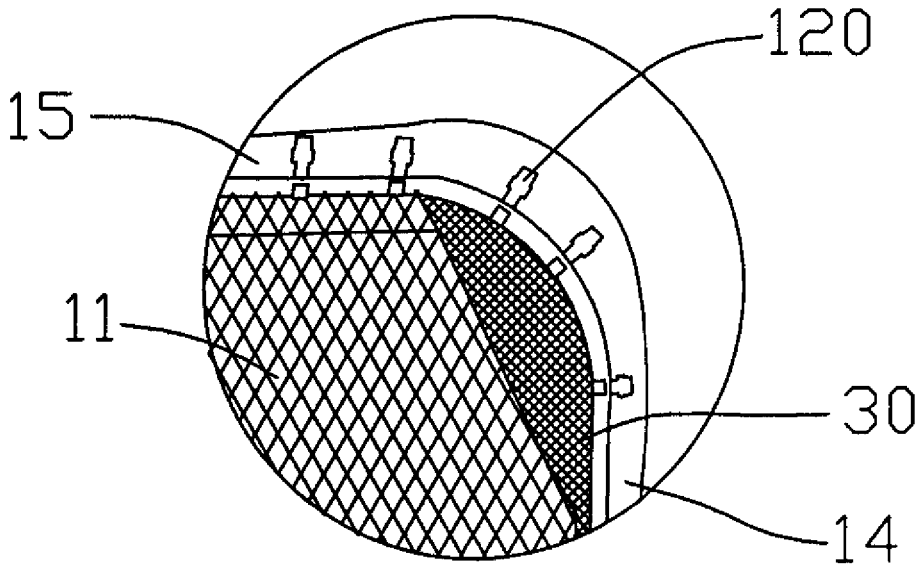
FIG. 3 is a schematic, enlarged view of part III of the frame of the device of FIG. 1.

In order to define shapes of the pliable frame 12 and the pliable base bracket 16, for example a rectangular (i.e., base bracket 16) or square (i.e., frame 12) shape as shown in FIG. 1, they are separately wrapped with a fabric tape. Further, a number of triangular fabric tapes 30 are applied to four corners between the lower frame 13, two side segments 14 and the upper segment 16 of the frame 12, and four corners of the four portions of the base bracket 16, as shown in FIGS. 2 and 3. This can enhance the stability of the frame 12 and the base bracket 16. After disassembling the frame 12 from the base bracket 16, the frame 12 and the base bracket 16 can be separately folded to relatively smaller volume by utilizing their pliability, thereby facilitating carry of the device 10.

Furthermore, a target 122 is attached to the frame so that the practicers can aim at it to practise their striking accuracy of balls. Each side portion 18 defines a half length or less half length of the side segment 14 of the frame 12. For example, when the frame is a square shape, the base bracket 16 is a rectangular shape provided with a length (of the connecting portion 17) equal to that of the frame 12 and a side length (of the side portions 18) equal to a half length of the frame 12. The frame and the bracket of the traditional ball practice device are square. Thus, the base bracket 16 of the present embodiment occupies relatively less area than the bracket of the traditional device, thereby decreasing space in use and facilitating use in an indoor space.

The connecting mechanism can be disassembled or taken apart. For example, as shown in FIG. 2, two pairs of adherent strips which can be torn apart are attached to the lower segment 13 and the connecting portion 17 to facilitate disassembling of the frame 12 and the base bracket 16. In other embodiments, the connecting mechanism could be buttons, snapping mechanism, or a zipper sewed into the fabric tape. In traditional ball practice device, the frame and the bracket are sewed together and cannot be departed from each other, so the combined frame and the bracket must be folded at the same time. However, when one of the frame and the bracket is firstly folded, the other one will produce interference in the folding process due to pliability thereof. As a result, it is arduous for the practicer to fold the frame and the bracket of traditional device. Further, due to requirement for such arduous folding, the traditional frame and bracket are prone to be distorted, thereby reducing service period thereof. In the ball practice device 10 of the present embodiment, the frame 12 and the base bracket 16 may be departed from each other so that they can be folded separately, thereby requiring a relatively lower time-consumption and less folding hard when folding the two parts. As such, the device 10 of the present embodiment has a long service period.

Referring to FIG. 3, the connecting member includes a number of hooks 120 attached to the frame 12. Specifically, the hooks 120 are uniformly coupled to the fabric tape wrapping around the lower segment 13, two side segments 14 and the upper segment 15. The net 11 is woven by intercrossing net threads. The net threads at the circumference of the net 11 are hitched on the hooks 120, thereby coupling the net 11 to the frame 12. When the net 11 is broken down or worn out for a long operating period, it is convenient to replace a new net. As described above, in the traditional ball practice device, the net is sewed in the fabric tape of the frame and is configured as a whole together with the frame. As such, once one of the net and the frame is breakage, the entire ball practice device needs to be cast off. On the contrary, in this embodiment, the net 11 is coupled to the frame 12 by the connecting member (e.g., the hooks 120) and thus can be disassembled from the frame 12. Thus, once the net 11 or the frame 12 is broken down or worn out, only the broken or worn part is cast off and is replaced with a new one and it is no necessary to cast off the entire device 10. This decreases expense for the practicer, increases availability and use value of the device 10.

Figure 4:
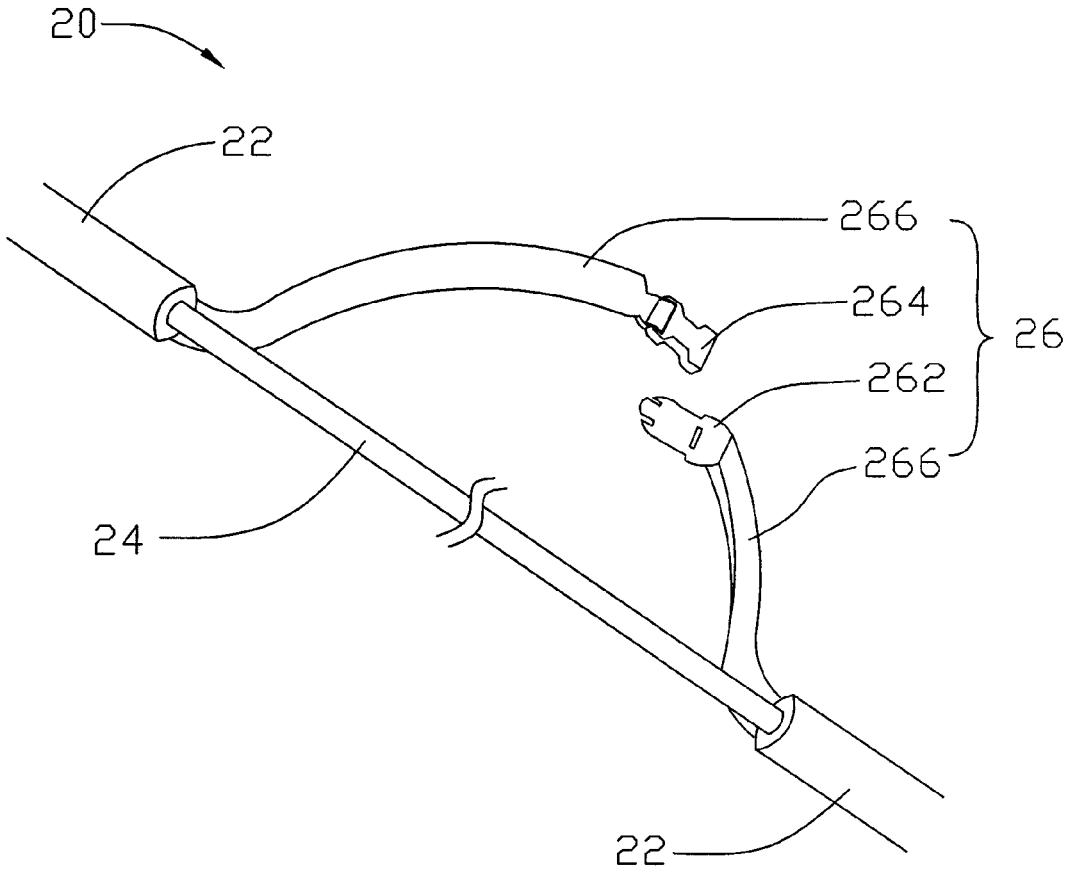
FIG. 4 is a schematic, structural view of a supporting assembly of the device of FIG. 1.

The supporting assembly 20 is interposed and supported between a side segment 14 of the frame 12 and a side portion 18 of the base bracket 16. As shown in FIGS. 1 and 4, two supporting assemblies 20 are applied between side segments 14 of the frame 12 and side portions 18 of the base bracket 16. The two supporting assemblies 20 cooperating with the base bracket 16 support the frame 12. Each supporting assembly 20 includes two sleeves 22 separately coupled to one side segment 14 of the frame 12 and one respective side portion 18 of the base bracket 16, a supporting rod 24, and a snap fastener 26. The supporting rod 24 has two ends inserting into the two sleeves 22, respectively. The snap fastener 26 has two ends connected to the two sleeves 22, respectively. The sleeves 22 are made of the same material to the fabric tape, among other woven material. Each sleeve 22 has an opening end allowing for insertion of the rod 24 and a sealed end secured (e.g., sewed) to fabric tape wrapping around the side segment 14 or side portion 18. The supporting rod 24 is made of, e.g., glass fiber or metal such as iron. The supporting rod 24 is advantageously in a tubular shape and includes a number of segments which have folding, detachable, and adjustable function. In the illustrated embodiment, the supporting rod 24 is a folding and adjustable iron tube consisting of three segments. The inclined angle between the frame 12 and the base bracket 16 may be adjusted by changing length of the supporting rods 24. For instance, for the supporting rod 24 provided with three segments, when all the three segments obtain complete extension, the inclined angle between the frame 12 and the base bracket 16 is about 85 degree. When one of the three segments is contracted, the inclined angle between the frame 12 and the base bracket 16 is about 75 degree. When two of the three segments are contracted, i.e., the supporting rod 24 is contracted to be a length of one segment, the inclined angle is about 47 degree. It is understood that the supporting rod 24 could consist of more segments to obtain more options of the adjustable inclined angles between the frame 12 and the base bracket 16. Further, during disassembling, the supporting rod 24 can be drawn out of the two sleeves 22 so that the frame 12 and the base bracket 16 can be separately folded. Apparently, the supporting assemblies 20 could be folded along with the folding of the frame 12 or the base bracket 16.

The snap fastener 26 includes a male part 262, a female part 264, and two connection ribbons 266. The male and female parts 262, 264 are coupled to two opening ends of the two sleeves 22 by the two connection ribbons, respectively. The connection ribbons 266 combined with the male and female parts 262, 264 strain closely the two sleeves 22 so as to tightly hold two ends of the supporting rod 24 in the two sleeves 22. The length of the two connection ribbons 266 advantageously may be adjustable for matching with length adjustment of the supporting rod 24.

Figure 5:
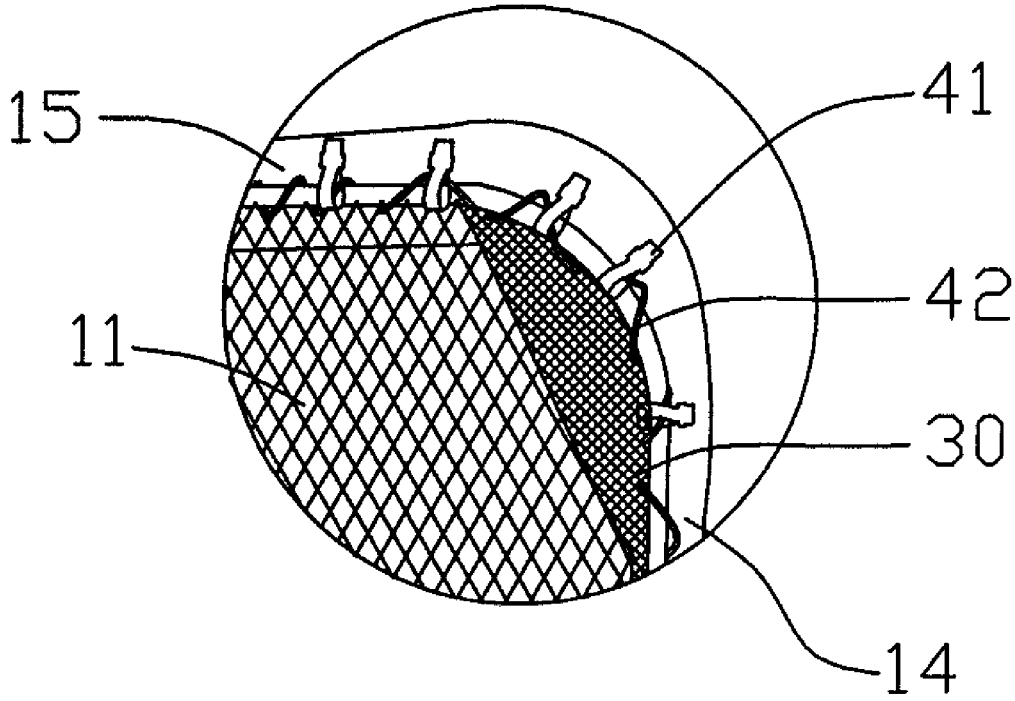
FIG. 5 is a schematic, partial view of joint region between a frame and a net of another ball practice device according to a second embodiment of the present invention.

FIG. 5 illustrates a connecting member of another ball practice device, in accordance with a second embodiment of the present invention. The ball practice device of the second embodiment is essentially similar to the ball practice device 10 of the first embodiment as described above, except for the connecting member. Therefore, only joint region between the frame 12 and the net 11 showing the connecting member of the second embodiment is illustrated in FIG. 5. The elements shown in FIG. 5 which are substantially similar to the elements of the first embodiment are designated as the same reference number in FIG. 3 and structure thereof may refer to description above. The connecting member of the second embodiment includes a number of rings 41 and a string 42. The rings 41 could be made of the same material to the fabric tape and be sewed all along the circumference of the fabric tape of the frame 12. The string 42 penetrates through net holes defined between the net threads of the net 11 and the rings 41 in sequence, thereby linking the net 11 to the frame 12. When replacing the net 11 with a new net, the original net 11 can be disassembled from the frame 12 by drawing out the string 42 from the rings 41 and the net holes of the net 11. Then, the new net is attached to the frame 12 by linking the net 11 to the rings 41 via the string 42.

The ball practice device as described above is available for practising a variety of balls such as football, hockey ball, baseball, tennis ball, table tennis, and golf ball, etc. For example, user may set up the ball practice device in an indoor space for taking an indoor-golf practice. The golfer can practise hitting motion and golf swing, or practise striking accuracy of golf ball by aiming at the target 122. During practising, the balls are collected at bottom of the net 11 and thus the golfer need not pick up the balls all around the ground.

In the ball practice device as described in above embodiments, the net 11 is attached to the frame 12 by the connecting member which the net 11 can be disassembled from. Thus, it is convenient to disassemble the net 11 from the frame 12 and fix the net 11 to the frame 12. Thus, the connecting member provides convenience for replacing the net 11 which is easily broken up after long-term exercise. This decreases sport expense for the practicer, increases availability and use value of the device, and also prolongs service period of the device.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A ball practice device comprises:

a frame;

a net attached to the frame, the net being connected to the frame by a connecting member which the net can be disassembled from;

a base bracket; and a supporting assembly interposed between the frame and the base bracket, the supporting assembly being configured for supporting the frame together with the base bracket, wherein the frame comprises a lower segment, two side segments respectively adjoining two ends of the lower segment, and an upper segment opposite to the lower segment, the base bracket comprising a connecting portion, two side portions adjoining two ends of the connecting portion, and a portion opposite to the connecting portion, the lower segment of the frame being coupled to the connecting portion of the base bracket by a connecting mechanism which can be disassembled to depart the frame from the base bracket, wherein the supporting assembly comprises two sleeves separately coupled to a side segment of the frame and a respective side portion of the base bracket and a supporting rod, the supporting rod having two ends for inserting into the sleeves, and wherein a snap fastener is connected between the two sleeves, the snap fastener being configured for straining the two sleeves so as to hold the two ends of the supporting rod in the two sleeves and allow the supporting rod to support the frame together with the base bracket.

2. The device as claimed in claim 1, wherein the connecting member comprises a plurality of hooks for hitching net threads of the net thereon so that the net is attached to the frame.

3. The device as claimed in claim 1, wherein the connecting member comprises a plurality of rings and a string, the string penetrating through net holes defined between net threads of the net and the rings in sequence so that the net is attached to the frame.

4. The device as claimed in claim 1, wherein each sleeve has an opening end allowing for insertion of the supporting rod and a sealed end secured to the respective side segment/side portion.

5. The device as claimed in claim 1, wherein the supporting rod comprises a plurality of segments which can be folded and adjustable in length.

6. The device as claimed in claim 1, wherein the connecting mechanism comprises one of adherent strips, buttons, snapping mechanism, and a zipper sewed into a fabric tape.

7. The device as claimed in claim 1, wherein a side portion of the base bracket defines a half length or less than half length of the respective side segment of the frame.

* * * * *